United States Patent [19]

Garnett

[11] 4,453,672

[45] Jun. 12, 1984

[54] VEHICLE MOUNTED AERIAL LIFT

[76] Inventor: Edward V. Garnett, 9152 Kahului Dr., Huntington Beach, Calif. 92646

[21] Appl. No.: 361,097

[22] Filed: Mar. 23, 1982

[51] Int. Cl.[3] ..... A62C 27/00; B66F 9/20

[52] U.S. Cl. ..... 239/166; 169/24; 182/2

[58] Field of Search ..... 182/2; 239/165, 166, 239/169, 172; 169/24, 25; 414/696, 706, 710, 728

[56] References Cited

U.S. PATENT DOCUMENTS

| | | | |
|---|---|---|---|
| 1,953,390 | 4/1934 | Bosch | 182/2 X |
| 3,253,677 | 5/1966 | Krynytzky et al. | 169/24 X |
| 3,522,898 | 8/1970 | Rotheisler | 414/710 X |
| 3,670,849 | 6/1972 | Milner, Jr. | 182/2 X |
| 3,675,721 | 7/1972 | Davidson et al. | 239/165 X |

FOREIGN PATENT DOCUMENTS

| | | | |
|---|---|---|---|
| 1362832 | 4/1964 | France | 182/2 |

*Primary Examiner*—Andres Kashnikow

*Attorney, Agent, or Firm*—Horace B. Van Valkenburgh

[57] ABSTRACT

A lower boom is pivotally mounted on a turntable and moved upwardly and downwardly by a hydraulic cylinder, the lower end of which may be pivoted on the same pivot shaft as that on which a pair of links are pivoted. The outer ends of the links are pivotally connected to the lower end of a knee joint, preferably formed of heavy plate and attached to the inner end of an upper boom, while the outer end of the lower boom is pivotally attached to the knee joint above the links. An extensible boom, hydraulically moved inwardly and outwardly of the upper boom, may carry a workman's basket and/or a hydraulic nozzle, as for extinguishing fires. The distance between the pivotal connections of the links and the lower boom to the turntable, the relative length of the lower boom and links and the distance between the pivotal connections of the outer ends of the lower boom and the links to the knee joint or upper boom are preferably proportioned so that the outer end of the extensible boom, at any set position, will rise in a generally vertical line, as the lower boom is elevated. During such movement, the knee joint will remain on the opposite side of the center line of the turntable from the extensible boom and basket, thereby contributing materially to the balance of the structure and thereby, in many installations, avoiding the use of jack legs or outriggers. A special line for supplying water to the nozzle consists of pipes attached to the upper and lower boom, an extensible pipe within the upper boom pipe, hose connections between the pipes and between the lower end of the lower boom pipe and a supply pipe. The latter includes special fittings permitting the turntable to move through 360° or more.

18 Claims, 20 Drawing Figures

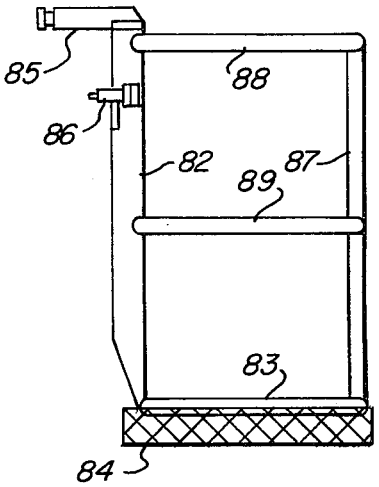
Fig.-15
Fig.-2
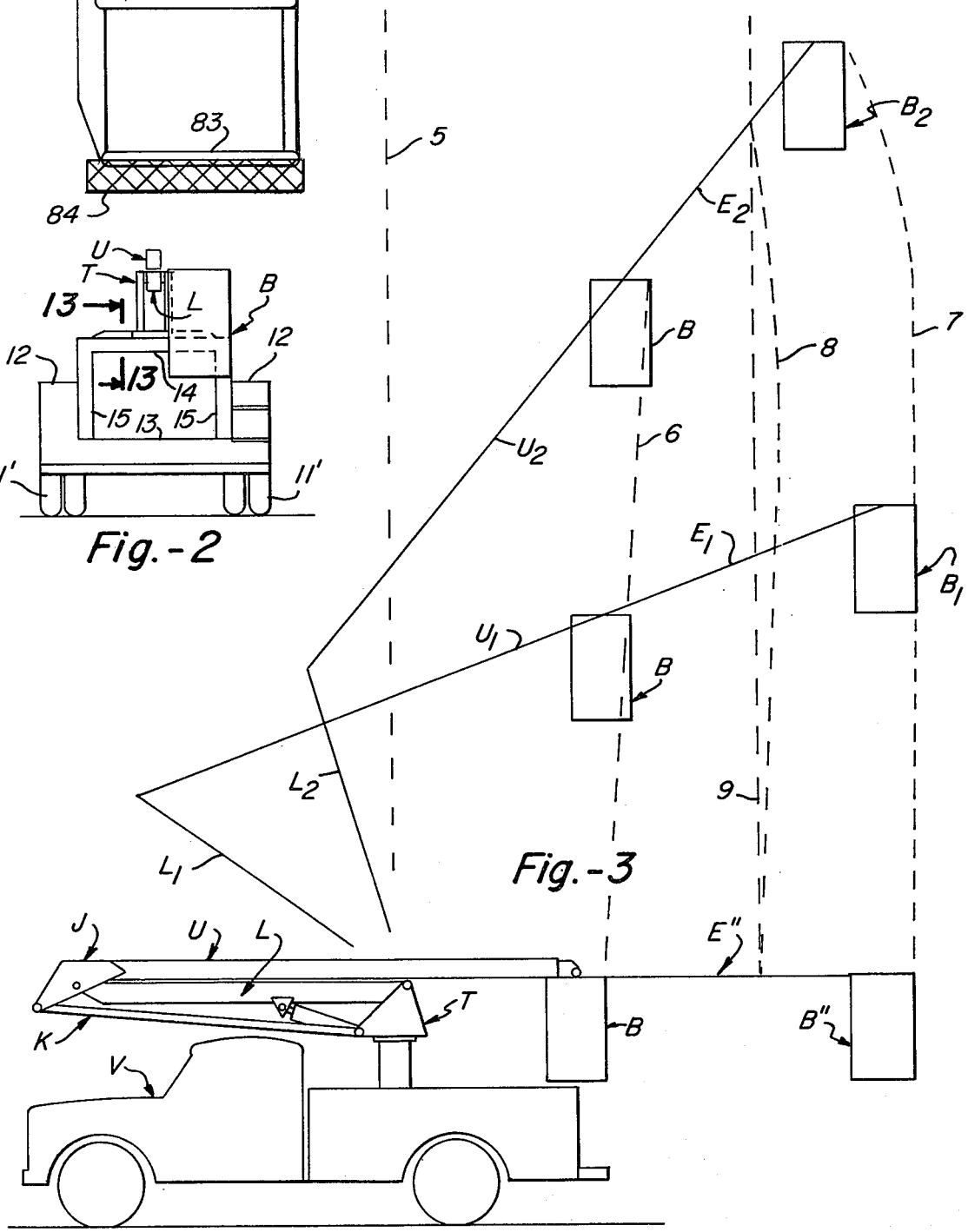
Fig.-3

J
T
20
21
23
29
30
34
35
36
42
69
70
71
72
73
74
75
76
77
78
79
80
14

VEHICLE MOUNTED AERIAL LIFT

This invention relates to aerial lifts.

BACKGROUND OF THE INVENTION

Prior aerial lifts or hydraulic platforms may include those which are simply telescopic, i.e. a hydraulic cylinder is attached to a pivoted boom to elevate and lower, while one or more extensible booms, the innermost of which carries a workman's cage or basket, may extend from within the pivoted boom. Such types of lifts may be represented by U.S. Pat. No. 3,056,510 and by the Versalift lift, manufactured by Time Manufacturing Company of Waxco, Tex. Another type of lift may include a pair of booms, with the inner end of the upper boom pivotally connected to the outer end of the lower boom. The lower boom is elevated and lowered by a hydraulic cylinder, while the upper boom is elevated and lowered by a second hydraulic cylinder, pivotally connected between the booms. This type of lift may be represented by U.S. Pat. Nos. 3,670,849 and 4,081,055. In another type, which may be represented by the Dura-Lift, supplied by Durnell Manufacturing, Inc. of Emmetsburg, Iowa, a hydraulic cylinder, connecting the lower boom with the upper boom, is articulated by a linkage system which is connected to the upper boom and lower boom, as at points spaced from a pivotal connection between the two booms. A similar construction is shown by U.S. Pat. No. 4,222,457. There are also combination articulated and telescopic types of lifts, such as the Condor supplied by Calavar Corporation of Santa Fe Springs, Calif. in which both the lower boom and the upper boom are provided with an extensible boom, with the inner end of the upper boom pivoted on the outer end of the lower extensible boom and an articulating linkage connecting the two. As a result, the workman's basket can be raised to a considerable height, such as to a distance on the order of 144 feet from the ground. In another type, the articulation is inverted by rods or cables connected through levers, with the raising and lowering controlled by hydraulic cylinders of larger diameter but relatively short stroke. One example of this type if the Stel-Lift, produced by Stelco, Inc., of Overland Park, Kans. In other types, the telescopic effect is limited by mechanical construction, such as a ladder which is pivoted upwardly and extended by cables, as in the case of the aerial ladder manufactured by Van Ladder, Inc. of Spencer, Iowa.

One of the problems associated with any aerial lift, which is to be extended in any direction except fore and aft of the vehicle carrying it, is the problem of balance of the vehicle at higher positions of the basket, particularly lateral extensions. Since the lateral distance between wheels of a vehicle is normally considerably less than the length of its wheel base, the problem of imbalance becomes more acute as the lift is rotated to a lateral position, i.e. at 90° to the longitudinal axis of the vehicle. The customary manner, in which such a problem has been overcome, is by the use of jacklegs or outriggers of various types, such as those which engage the ground at a point beneath the lateral edge of the vehicle; others are extended laterally for a distance by being pivoted downwardly and outwardly, while a similar result may be accomplished by use of a linkage system. There also are types of outriggers which include a moveable beam which is extended laterally from the vehicle for a considerable distance, then a leg is pivoted, or moved downwardly from the beam, in order to engage the ground. Generally speaking, outriggers or jacklegs require considerable time for setup and increase considerably the cost of the complete vehicle and aerial lift.

Among the objects of this invention are to provide an aerial lift which normally does not require outriggers, jacklegs or similar types of support for a vehicle; to provide such an aerial lift which permits rotation during use through a full 360° at any position; to provide such a lift which is inherently balanced by its construction; to provide such a lift which will accommodate extension and retraction of an extensible boom in addition to conventional lower and upper booms; to provide such a lift which requires a single hydraulic cylinder only, to raise and lower a pair of pivotally connected, lower and upper booms; to provide such a lift having a workman's basket which is inherently moveable to any position in a desirable work area; to provide such a lift which causes the workman's basket to move generally upwardly when the hydraulic cylinder is extended, rather than in an arc toward or away from the vehicle; to provide such an aerial lift which may be made so that it does not require connection of controls or hydraulic hoses to the vehicle; to provide such an aerial lift which may be completely controlled from a workman's basket; to provide a supply line for a nozzle at the upper end of the lift, which will accommodate relative movement between various parts of the lift, as well as rotation of the lift to different angular positions; to provide such a lift which may be easily locked in a storage position to minimize bearing stresses due to sway of lift parts during movement of the vehicle along a road or the like, as well as unlocked when use of the lift is to be resumed; and to provide such a lift which is effective in operation and relatively low in cost.

SUMMARY OF THE INVENTION

The aerial lift includes a turntable which is mounted on the vehicle for rotation through 360° and is pivotally connected to a lower boom and a pair of links, the opposite end of which is pivotally connected to a knee joint. A hydraulic cylinder is pivotally connected to the turntable, at its lower end, while its piston rod is pivotally connected to the underside of the lower boom. The knee joint receives the inner end of an upper boom and also provides sufficient weight to counterbalance the weight of a device for accomplishing an objective, such as a workman's basket or a hose nozzle or the like, and a portion of an extensible boom, retractably within and extendable from the upper boom. The knee joint may include relatively heavy side plates and similar top, bottom, and end plates. A reinforcing rib may be placed on each side plate for extension to the position of a pivot pin for the outer end of the lower boom. The distance between the pivotal connections of the lower boom and the links is proportioned so that elevation of the lower boom will cause the upper boom to form an angle with the lower boom which increases as the lower boom and upper boom move upwardly. The construction thus permits the knee joint to remain on one side of the center line of rotation of the turntable. Also, the position of the basket, in the fully extended position of the extensible boom, approaches closer to the center line as the booms are moved upwardly. The turntable may be provided with a battery or batteries and a combined electric motor and hydraulic pump, so that the lift does not require electricity from the vehicle, as when its engine is driving a hydraulic pump. A nozzle may be mounted on the basket, with supply pipe attached to the side of each of the lower and upper booms and a pipe telescoping into the latter connected with the nozzle. Hoses may connect the pipes mounted on the booms and a swivel connection centrally of the turntable with the lower boom pipe.

THE DRAWINGS

FIG. 2 is a rear elevation, on a reduced scale, of the aerial lift and vehicle of FIG. 1.

FIG. 3 is a side elevation, on a reduced scale, of the aerial lift and vehicle of FIG. 1, including a diagram of two elevated positions of lower boom, an upper boom, an extensible boom and a workman's basket mounted on the latter.

FIG. 15 is a side elevation of a workman's basket.

DESCRIPTION OF THE PREFERRED EMBODIMENT

Figure 1:
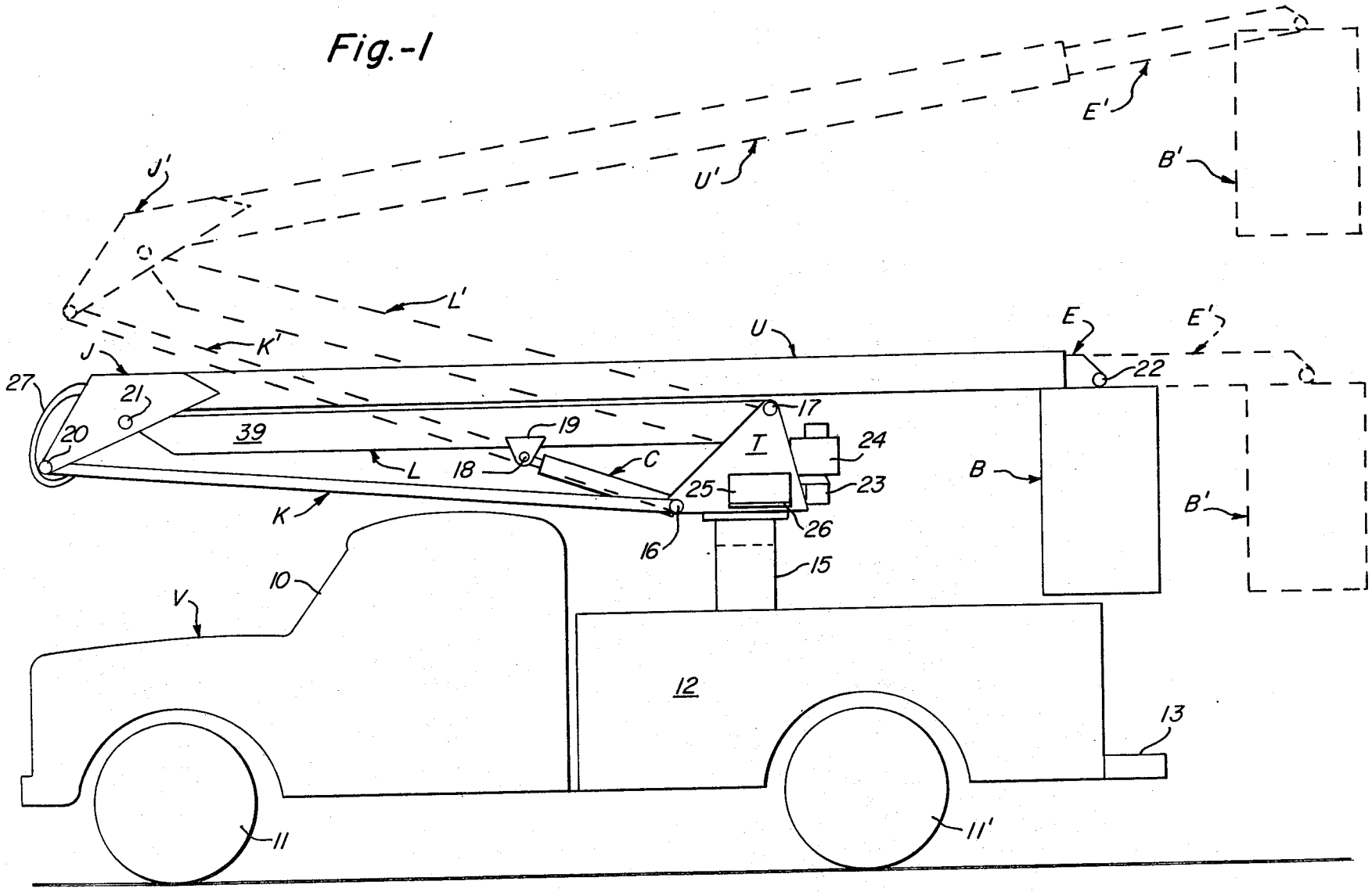
FIG. 1 is a side elevation of an aerial lift of this invention in storage position on a vehicle and showing certain other positions of parts thereof in dotted lines.

An aerial lift of this invention may be mounted on a vehicle V, as in FIGS. 1 and 2, and may include a turntable T, conveniently rotatable 360°, on which a lower boom L and a pair of links K are pivoted at different positions. A hydraulic cylinder C, which may be pivoted at the same position as the links K, is pivotally attached to lower boom L to elevate or lower the same. A knee joint J, whose construction and weight are an additional feature of the invention, is mounted on and receives a portion of the inner end of an upper boom U, while both the lower boom L and the links K are pivotally connected to the knee joint. One feature of this invention is the slightly modified parallelogram, whose sides are formed by lines connecting the pivot points at the ends of the lower boom and links and whose ends are formed by the lines between the outer pivot points of the lower boom and links and the inner pivot points of the lower boom and links, respectively. An extensible boom E is slidable outwardly and inwardly within upper boom U, while a workman's cage or basket B is pivotally supported by the extensible boom. As in FIG. 1, the extensible boom E may be shifted to a position E', with the basket B thereby being moved to a position B', with the booms in retracted position. Also, the hydraulic cylinder C may be extended to move the lower boom L upwardly to a position L', which automatically moves the joint J to a position J' and the upper boom U to a position U', with the links K moving to a position K' and determining the angularity between the lower boom and the upper boom. Also, the extensible boom E may be moved outwardly, such as to a position E', in which the basket B reaches a position B'. It will be noted that the sides of the modified parallelogram formed by the lines between the above pivot points will remain the same in length, but that the angles at the corners of the modified parallelogram will vary when the lift is shifted, as from the full to the dotted positions of FIG. 1.

As illustrated diagrammatically in FIG. 3, the lower boom may be elevated to positions $L_1$ and $L_2$, respectively, with the links K again determing the angularity of the upper boom with respect to the lower boom. Thus, positions $U_1$ and $U_2$ of the upper boom in FIG. 2 correspond to the respective positions $L_1$ and $L_2$ of the lower boom. When the extensible boom is retracted, the basket B will be in a position at the end of the upper boom, as indicated for the $U_1$ and $U_2$ positions thereof. However, when the extensible boom is fully extended to the $E_1$ and $E_2$ positions, the basket B will then reach the positions $B_1$ and $B_2$, respectively. Similarly, when the lift is in the down or storage position but the extensible boom E is fully extended, it will reach a position E'' and the basket a corresponding position B''. It will be noted that as the lower boom is elevated, the angle between the upper boom and lower boom will increase, so that in the positions illustrated in FIG. 3, the joint J, which is located at the intersection of the lower boom and upper boom, will always be on the opposite side of a center line 5 of the turntable T. Thus, the weight of the joint J will always be on the opposite side of the center line from the basket B, even in the extended positions $B_1$ and $B_2$, irrespective of the radial position of the turntable T through a full 360° movement.

A distinct advantage of a lift of this invention is the area in which working operations may take place. Through the modified parallelogram relationship of the pivot points of the lower boom and links, a working area is provided which has definite advantages over the working area of prior lifts, including particularly the inverted articulated type and the ladder type. The above previous types of lifts can be elevated to a position directly above the vehicle, but this capability, which is rarely needed, sacrifices ability to extend higher and further at other positions. Thus, the inner limit of the work area provided by the lift of this invention is defined by the dotted line 6, between the three positions B of the workman's basket of FIG. 3, while the outer limit is approximated by the dotted line 7, which extends upwardly from the position B″ to the position $B_1$, which may be a few inches further from the center line 5 than the position B″, and thence to the position $B_2$, which is slightly closer to the center line 5. The dotted line 8 extends between the mid points of the extensible boom in the positions E″, $E_1$ and $E_2$, thereby representing the position of the basket B when the extensible boom is extended 50 percent. For comparison therewith, dotted line 9 is a vertical line, parallel to center line 5 and extending between the lower and upper midpoints of the extensible boom E. Lines 6 and 7 define an area in which the maximum amount of work will take place, as well as an area within which the basket will rise for successive elevations of the lower boom L, in a generally upright line for any setting of extensible boom E, which is particularly pronounced at a mid setting of the extensible boom, since line 8 follows line 9 very closely. A big advantage of such a work area is that when a workman is in the basket and the lower boom is elevated, the workman need be cautious only about objects generally overhead and continued adjustment of the extensible boom, or shifting of the vehicle, becomes unnecessary. A further advantage of the work area is that it includes positions of the basket which are not reachable, without change of the position of the vehicle, by prior constructions. For instance, position $B_1$ is above and position $B_2$ is elevated considerably above corresponding points on the circle which is described by the maximum extension of a basket, either mounted on a boom pivoted on the turntable and provided with an extensible boom, or mounted on a pivoted ladder. The maximum extent of an inverted articulated type of lift is generally an ovoid, somewhat higher at the center, directly above the vehicle , but otherwise essentially a circle. The ratio of distances and angles of the modified parallelogram of the embodiment illustrated will be described later.

When the weight of the basket and its contents or attachments and the extensible boom are sufficiently counterbalanced, the vehicle V will not require outriggers or other devices which are normlly used to prevent a vehicle from tipping over when a hydraulic lift carried by the vehicle is extended to its maximum in a lateral direction. Thus, a lift of this invention mounted on a vehicle of the type illustrated, was tested with a load to ascertain whether the basket would carry a weight of 150% of its rated capacity, in accordance with accepted requirements, with the lift in a position laterally of the vehicle and the extensible boom fully extended with the upper boom at its greatest elevation. Not only did the vehicle remain stable with a load of 150% of its rated capacity attached to the basket, but the vehicle remained stable when the load was increased to 200% of the rated capacity of the basket. The lift of this invention is designed to carry a workman and tools or parts to a reasonable high position, such as on the order of 35 feet from the ground to the bottom of the basket, corresponding to the $B_2$ position of the basket of FIG. 3. To achieve such a height and also movement of a basket B to the working area between lines 6 and 7 of FIG. 3, the base of turntable T may be approximately 6 feet above ground level, the length between pivot points of lower boom L and links K may be approximately 11 feet and the distance between the inner pivot points of boom L and links K may be approximately 27 inches, while the distance between the outer pivot points thereof may be approximately 18 inches. Also, the length of upper boom U may be 16.5 feet from its pivot point and the length of extensible boom E may be 12.5 feet, with a 2.5 foot overlap within boom U. It will be understood, of course, that these dimensions may vary considerably.

The vehicle V, as in FIGS. 1 and 2, may be provided with a cab 10, front and rear wheels 11, a pair of side panels 12 and a bed 13. The turntable T may be mounted on a cross beam 14 supported by a pedestal 15 at each side of bed 13, as in FIG. 2, with rotation provided in a manner described later. Turntable T supports a lower pivot pin 16 for both the links K and the inner end of hydraulic cylinder C, as well as an upper pivot pin 17 for the lower boom L. The piston rod of hydraulic cylinder C is pivotally connected to the lower boom L at a pivot 18 on a bracket 19 attached to the lower boom. The outer end of each link K extends to a pivot pin 20 at the lower apex of joint J, while the outer end of the lower boom L extends to a pivot pin 21 on joint J. The basket B may be connected by a pivot pin 22 to the outer end of the extensible boom E. In order to avoid the necessity for running cables, hoses and the like between the vehicle and the turntable T, which may involve complications when the turntable is to rotate not only a full 360° but also for as many revolutions as desired, the lift may be self-powered. For the latter purpose, the turntable may carry a motor 23 for rotating the turntable, a combined motor and hydraulic pump 24 for suppling hydraulic fluid to the cylinder C and also to the cylinder of the extensible boom E, inside the upper boom U, and a pair of batteries 25, each mounted on a bracket 26 carried at the respective side of turntable T. Thus, the lift may be operated for a number of hours, such as a full working day or more, before the batteries need recharging. Control lines, such as electrical, and hydraulic hoses may be enclosed within a cable 27 which extends from the turntable T alongside one of the links K and thence around its pivot and into the upper boom U.

In the embodiment illustrated, which as indicated above is adapted to raise the workman's basket to a position on the order of 35 feet from the ground to the bottom of the basket, in the at rest position of FIG. 1, a line between inner pivot 17 and outer pivot 21 for the lower boom L is approximately horizontal. The distance between pivots 17 and 21 for the lower boom L may be on the order of 11 feet, while the distance between pivots 16 and 20 for links K may be on the order of approximately 11 feet 3 inches. The distance between pivots 16 and 17 may be on the order of 27 inches and the distance between pivots 20 and 21 on the order of slightly over 18 inches. The angles of the modified parallelogram formed by lines between the aforesaid pivots may be approximately 44° for acute angle 16-20-21, approximately 128° for obtuse angle 17-16-20 and approximately 152° for obtuse angle 17-21-20. The hydraulic cylinder C may be attached to the underside of lower boom L at a point such that the piston inside cylinder C will bottom out or reach the outer end of the cylinder when the lower boom L has reached position $L_2$ of FIG. 3, as at an angle of approximately 72° to the horizontal. The dimensions and angles discussed above may, of course, be varied considerably, depending on the desired height extension and the desired distance work area.

Figure 4:
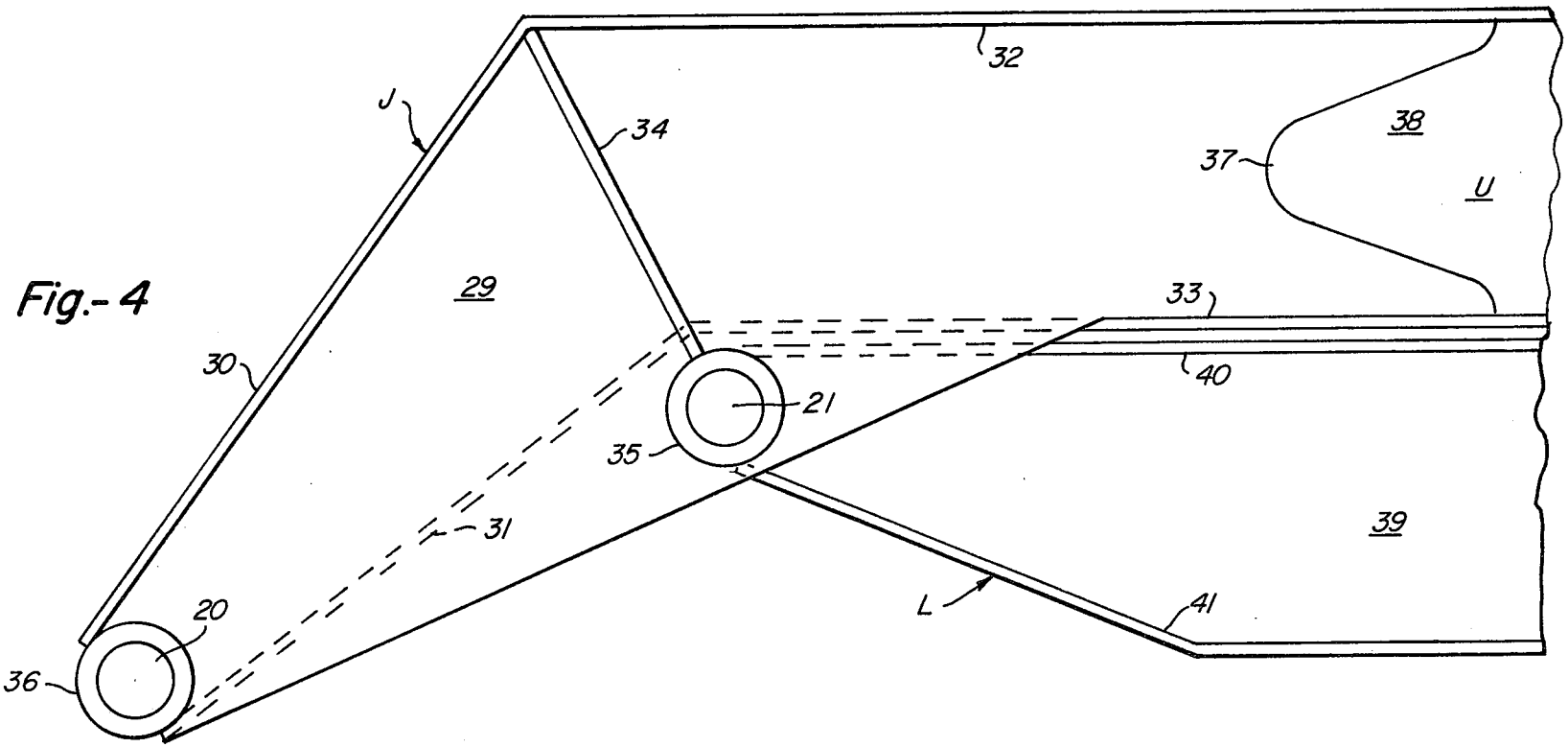
FIG. 4 is a side elevation, on an enlarged scale, of a knee joint which connects the inner portion of the upper boom with the outer end of the lower boom.
Figure 8:
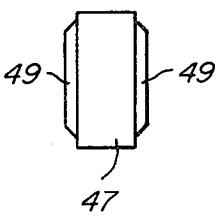
FIG. 8 is an end view of the link of FIG. 7.
Figures 5, 13, 14:
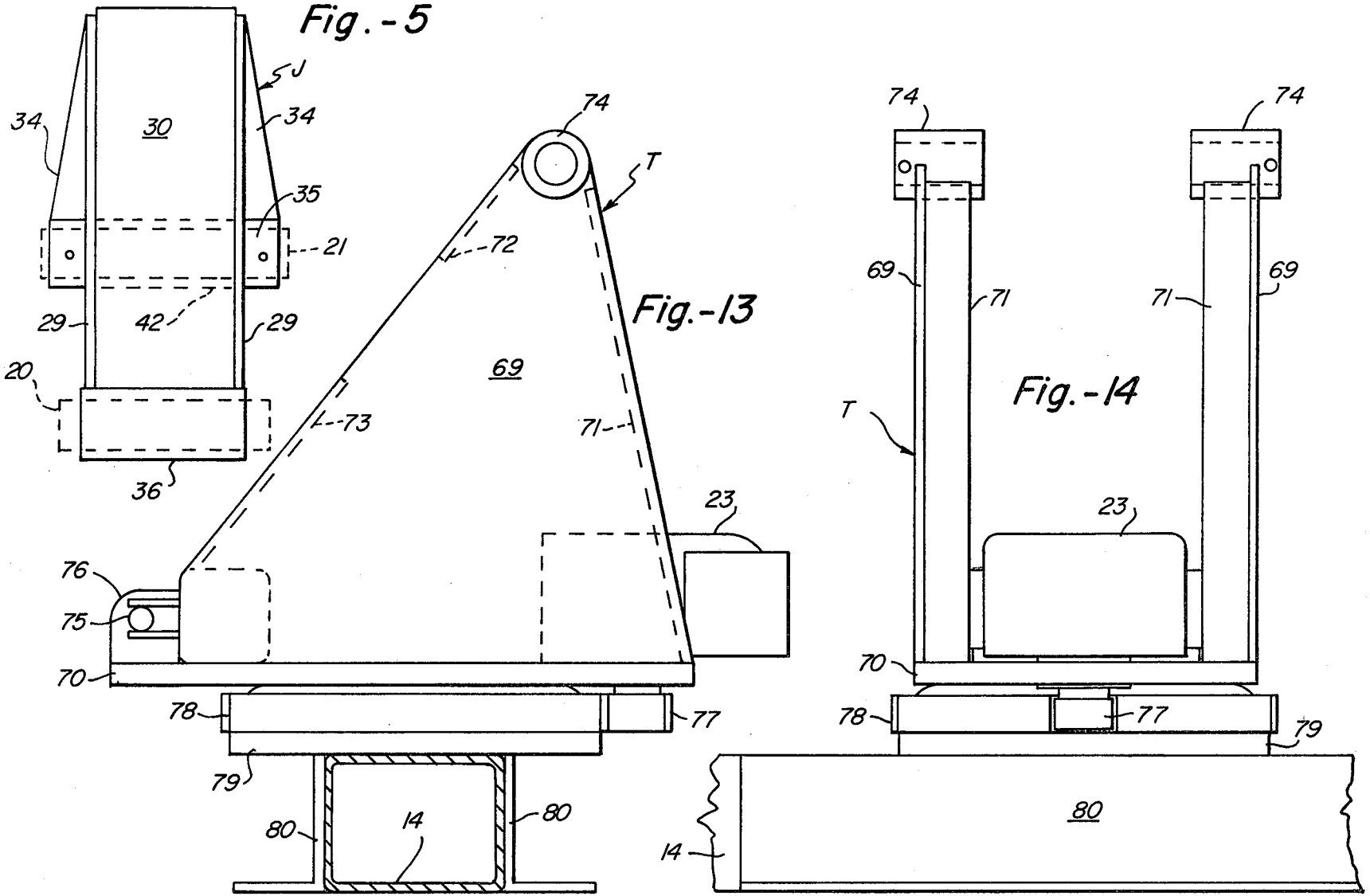
FIG. 5 is a rear elevation, on a reduced scale, of the knee joint of FIG. 4.
FIG. 13 is a side elevation of a turntable, partly in section along line 13—13 of FIG. 2.
FIG. 14 is a rear elevation of the turntable.

The joint J, as in FIGS. 4 and 5, may comprise a pair of heavy side plates 29 of the extent shown, between which a front plate 30 and a rear plate 31 extend and are attached to side plates 29, as by welding. A top plate 32 and a bottom plate 33 are also attached to the side plate 29, while a rib 34, at each side, extends downwardly from the upper apex of the joint J to a collar 35 which forms a support for pivot pin 21. Each collar 35 may be attached, as by welding, to the respective side plate 29, while a similar collar 36, through which pivot pin 20 extends, may be attached to the respective side plate 29 at an arcuate groove therein and also to plates 30 and 31, as by welding, Side plates 29 may extend to a notch 37 while the side plates, together with the upper plates 32 and lower plate 33, surround a rectangular tube 38 which forms the principal member of the upper boom U. As in FIG. 11, the top plate 32 and bottom plate 33 extend for a considerable distance along tube 38 past side plates 29.

The lower boom L may include a rectangular tube 39 which, at its outer end, is connected by a top plate 40 and an angular bottom plate 41 with a bushing 42 which surrounds pivot pin 21 and is shown in dotted lines in FIG. 5. At the opposite end of the lower boom L, as in FIG. 6, tube 39 is connected by a top plate 40' and an angular bottom plate 41' with a bushing 42' which surrounds pivot pin 17 of FIG. 1. Bracket 19 is, of course, attached to the underside of tube 39 at a position corresponding to that shown in FIG. 1.

Figure 7:
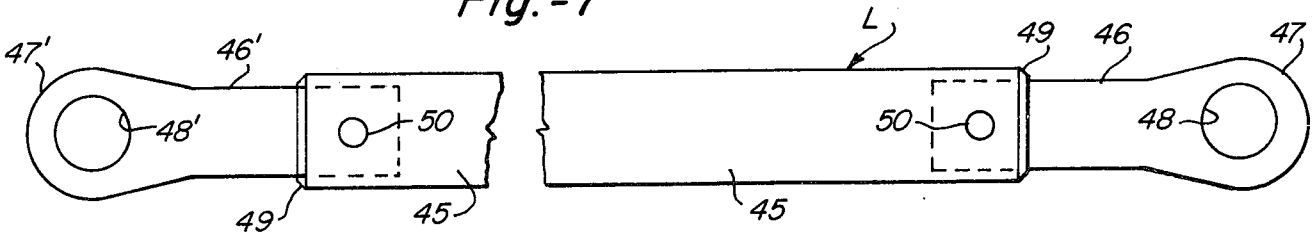
FIG. 7 is a condensed side elevation of a link which is pivotally connected between a turntable and the knee joint.

Each link L, as in FIG. 7, includes a rectangular tube 45, which extends between a rectangular rod 46 at one end and a similar rectangular rod 46' at the opposite end. Each rod extends into the tube 45 and is provided with an enlarged head 47 or 47', having a hole 48 or 48' which engages the respective pins 16 and 20 of FIG. 1. Tube 45 is provided with a bevel 49 around the respective rod 46 and 46', while each side of tube 45 is provided with a hole 50 adjacent each end, for filling with weld material to secure the tube to the respective rod 46 and 46'.

Figures 6, 9, 10, 11, 12:
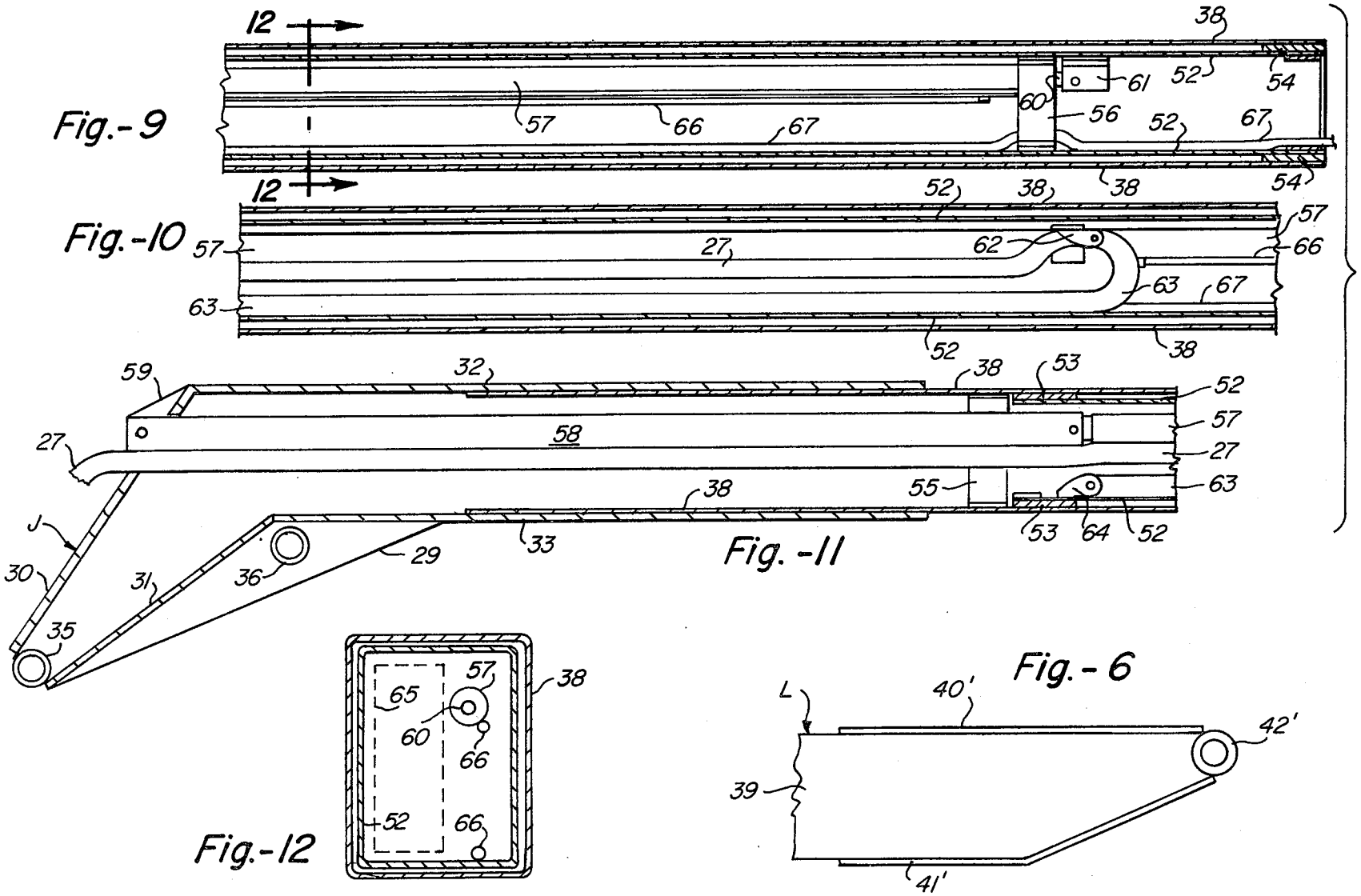
FIG. 6 is a side elevation of the inner end of the lower boom, the outer end of which is shown in FIG. 4.
FIG. 9 is a longitudinal section, on a reduced scale from that of FIG. 4, of the outer portion of the upper boom.
FIG. 10 is a similar longitudinal section of a central portion of the upper boom.
FIG. 11 is a similar longitudinal section of an inner portion of the upper boom, FIGS. 9, 10 and 11 thereby constituting a longitudinal section of the upper boom.
FIG. 12 is a cross section, on an enlarged scale, of the upper boom on line 12—12 of FIG. 9.

The upper boom U is illustrated in FIGS. 9, 10 and 11, which, if transferred and placed end to end, would comprise a longitudinal section of the entire upper boom and the joint J. The extensible boom E, inside tube 38 in retracted position, includes a rectangular tube 52 having lesser outer dimensions than the inside dimensions of tube 38 of upper boom U. A bearing plate 53 of FIG. 11 is affixed to the outside of the top, bottom, and sides of tube 52 at its inner end, for sliding within the tube 38 of the upper boom when the extensible boom is extended and retracted. A similar set of bearing plates 54 of FIG. 9 are provided inside the outer end of tube 38 of the upper boom, within which tube 52 of extensible boom E may slide, again during extension and retraction. As in FIG. 11, the top plate 32 and bottom plate 33 of the joint J are attached to the top and bottom, respectively, of the tube 38 in a suitable manner, as by welding, while the side plates 29 of FIGS. 4 and 5 are similarly attached to the sides of tube 38. A rectangular brace 55 is mounted within tube 38 as a reinforcement, as in FIG. 11, just inwardly of the inner end of boom E when in fully retracted position. A bracket 56, inside tube 52 adjacent its outer end, acts as a support for the outer end of an hydraulic cylinder 57, which extends rearwardly from bracket 56. Cylinder 57 extends in an off-center position, as in FIG. 12, within the tube 38, as in FIGS. 9, 10 and 11, to a point adjacent the inner end of the tube, to a tubular support 58, to which the rear end of hydraulic cylinder 57 is connected. Support 58 extends rearwardly within tube 38 and joint J, through front plate 30 to a bracket 59 to which it is attached. A piston rod 60 of hydraulic cylinder 57 extends to a connector 61, which is attached to the tube 52 adjacent its outer end. Tube 52, of course, slides over bracket 56 as the piston rod 60 moves outwardly and inwardly. Cable 27 also enters joint J, such as just beneath support tube 58 and extends along the underside of the tube and also of cylinder 57 to a connector 62 mounted on cylinder 57 and connecting with a movable cable 63 which, when extensible boom E is retracted, extends rearwardly along the inside of the boom to a connector 64 which may be attached to the inside of the tube 53 adjacent bearing plate 54. As will be evident, when the extensible boom E is extended, connector 62 will remain stationary but connector 64 will move with the tube 52 past the position of connector 62 and further to a position in which the cable 63 extends in the opposite direction from that shown in FIGS. 10 and 11. Thus, the cable 63 need be only half as long as the maximum extension of the extensible boom. Between the connector 62 and connector 64, cable 63 may be threaded through a light chain, so that it may move from a position extending rearwardly from connector 62 to a position forwardly of connector 62 without becoming entangled. The chain and cable may occupy a position within a space indicated by the dotted rectangle 65 of FIG. 12. From connector 62, a hydraulic tube 65 extends along cylinder 57 to the outer end thereof for supplying hydraulic fluid thereto. From connector 64, a control cable 66 extends along tube 52, as at the bottom, as in FIG. 2, to the outer end of tube 52 and thence to the basket B, so that the operator in the basket may control the position of the basket. Such controls may be electrical or hydraulic.

The turntable T, as in FIGS. 13 and 14, may include a pair of triangular side plates 69 which are mounted on a circular base plate 70 and reinforced by inwardly extending flanges 71 at the rear, as in FIG. 14, and flanges 72 and 73 at the front. A collar 74 for receiving pivot pin 17 of FIG. 1 is mounted at the apex of each plate 69, while pivot pin 16 extends through a hole 75 in a bracket 76 at the front of each side plate. Drive motor 23 rotates a pinion 77 which engages a stationary gear 78 mounted on a bearing support 79, in turn mounted on beam 14, which may be reinforced, as by angles 80.

The basket B, as in FIG. 15, may include a post 82 extending upwardly in a central position from one side of a generally rectangular ring 83 formed of tubing and having a floor, as well as a protective ring 84 on the outside, formed of a mesh-like material. Post 82 may be provided at its upper end with pivot 85 and, at a lower position, a latch 86 for maintaining the angularity of the basket with respect to the extensible boom. A pair of posts, such as post 87 shown, may extend upwardly from the opposite corners of the tube 83, with tubular rails 88 and 89 extending in a rectangle with arcuate corners at spaced positions above tube 83 and attached to post 82 and posts 87.

Figure 16:
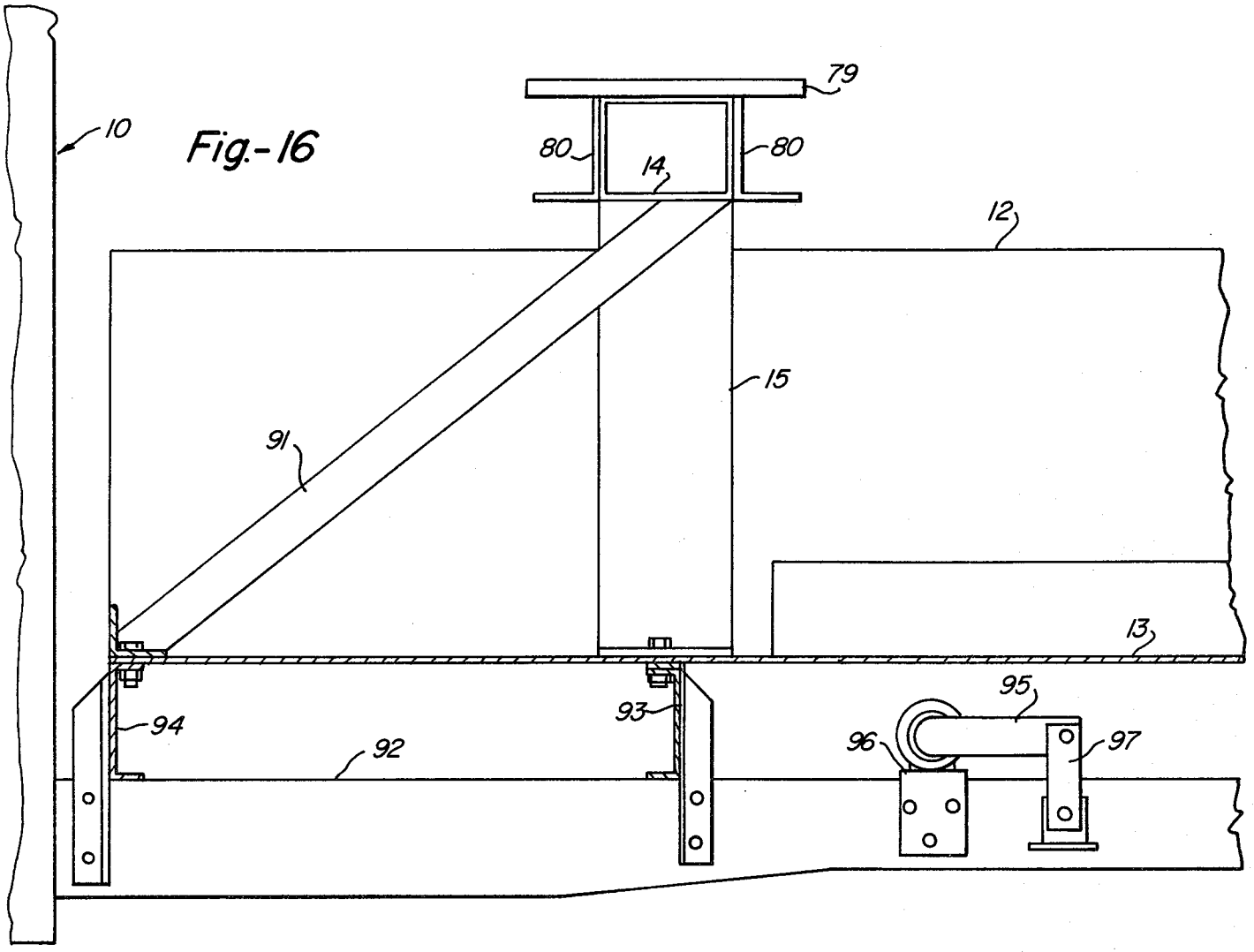
FIG. 16 is a side elevation of the mounting structure for the turntable and a portion of the vehicle.

The mounting structure for supporting the turntable T, as in FIG. 16, may include a brace 91 which extends angularly and upwardly from each front corner of bed 13 to the beam 14, while each pedestal 15 may be bolted to the bed 13, as shown. Bed 13 is supported above the longitudinal frame beams, such as beam 92, by cross beams 93 and 94, while a torsion bar 95 is provided with a connector 96 at one end, for attachment to frame beam 92 and, at the opposite end, with a connector 97 for attachment to the frame beam corresponding to frame beam 92, but opposite thereto and not shown.

Figure 17:
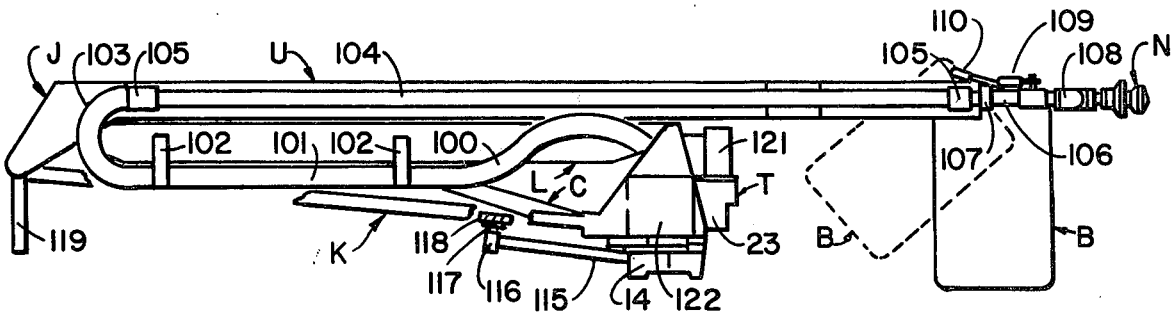
FIG. 17 is a side elevation of the lift, in storage position, showing particularly a fire nozzle or sprayer mounted on the outer end of the extensible boom, at the basket, and a hose and pipe structure for supplying water to the nozzle.
Figure 18:
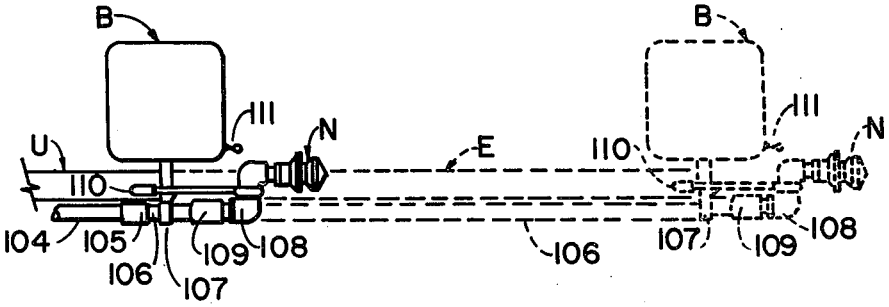
FIG. 18 is a top plan view of the outermost portion of FIG. 17, including the nozzle and basket, and also showing, in dotted lines, the extensible boom fully extended, carrying with it a telescoping pipe which supplies water to the nozzle.

The structure by which high pressure water is supplied to a nozzle N, for which a fog nozzle may be substituted, as in FIG. 17, in which links K are partially broken away to show parts between them, includes a flexible hose 100 extending between a connection at the turntable T, described later, to a fixed pipe 101 attached by brackets 102 to a lower edge of the lower boom L. Hose 100 accommodates movement of the lower boom, relative to the turntable T, during upward and downward pivotal movement of the lower boom, between the storage position shown in FIG. 17 and the elevated position $L_2$ of FIG. 3. A flexible hose 103 connects the outer end of pipe 101 with a pipe 104, mounted on the side of upper boom U, as by a bracket 105. Hose 103 has sufficient length to accommodate the relative movement between the upper boom and the lower boom, between the storage position of FIG. 17 and the maximum upright positions $L_1$ and $U_2$ of FIG. 3. A pipe 106 extends within pipe 104 and telescopes to different positions of the extensible boom E, being supported by a bracket 107 which is attached to the outer end of the extensible boom and also may pivotally support the basket B, as for movement between the full and dotted positions of FIG. 17. As also shown in FIG. 18, telescoping pipe 106 is connected to the nozzle N by an angle connection 108, associated with a valve 109. A handle 110, attached to the nozzle, permits the nozzle N to be pivoted to different angular positions, while a control handle 111 of FIG. 18 may be utilized in controlling the position of the basket B, with similar controls utilized in adjusting the position of the extensible boom.

The lift of this invention is particularly adapted to be utilized for fire fighting purposes and thus may be conveniently mounted on a pumper or similar type of equipment which will produce the desired water pressure for such purposes. The rise of the outer end of the extensible boom E, for any given position thereof, in substantially a vertical direction is of considerable value for fire fighting purposes, since the pumper may be parked close to a building which is on fire and the lift elevated to carry the nozzle to an upper position, adjacent the building without the necessity of adjusting the position of the vehicle or pumper in order to place the nozzle N as close as desired to the building, into or onto which the water from the nozzle is to be directed. When the lift is installed above pumping equipment, appropriate changes may be made in the reinforcement or supports of beam 14, which in turn supports the turntable T.

For maintaining the lift in storage position on the vehicle and particularly to relieve the stress on the bearings due to sway of the booms and other parts while driving down a highway, over a field or other places, an automatic lock may be utilized. This may be provided by an arm 115 of FIG. 17, mounted on beam 14 and carrying a socket 116 in which a spring pressed detent or locking bolt is enclosed, for engaging a hole in a boss 117, on the underside of a cross bar 118, shown in section and extending between and attached to the inside of each link K. When the lift is initially elevated, the cross bar 118 and boss 117 leave the locking bolt, so that the lift may be rotated freely. When the lift is to be returned to storage position, the turntable T is moved until the booms are aligned generally with the front of the vehicle, while the links K are slightly elevated. Then the lift is lowered until the cross bar 118 approaches the locking bolt, which is spring pressed and extends upwardly from the socket 116. As soon as the cross bar engages the bolt, the turntable may be rotated slowly until the locking bolt snaps into the hole of boss 117, whereupon the lift may be lowered slightly to storage position, as on a support 119 of FIG. 17. As will be evident, the locking bolt extending between fixed arm 115 and crossbar 118 will stabilize the assembly and oppose forces produced by any tendency of the booms and associated parts to sway, thereby relieving the bearings of stresses produced by such swaying.

Figure 19:
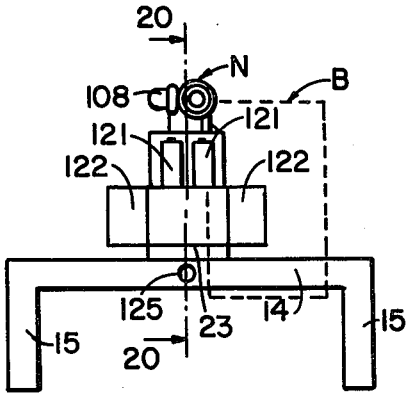
FIG. 19 is a rear elevation of FIG. 17.

In addition to the turntable drive housing 23, the turntable T may additionally carry a pair of power paks 121, shown also in FIG. 19, each of which is a self-controlled motor, hydraulic pump and hydraulic reservoir unit and supplies hydraulic fluid to the lift cylinder C, as well as hydraulic controls, when utilized. A series of batteries, for operating the power paks 121, may be contained in housings 122, and may be charged from a generator on the vehicle and contain a sufficient charge to operate the power paks for an extended period of time, such as two hours, to preclude the necessity for operating the electrical generator while the lift is in use. Such operation is particularly advantageous when the motor of the vehicle is being used to drive a booster pump for supplying nozzle N of FIGS. 17 and 18. Electrical leads to the batteries may include a swivel connection, so that the electrical leads may be used to supply the power paks when desired.

Figure 20:
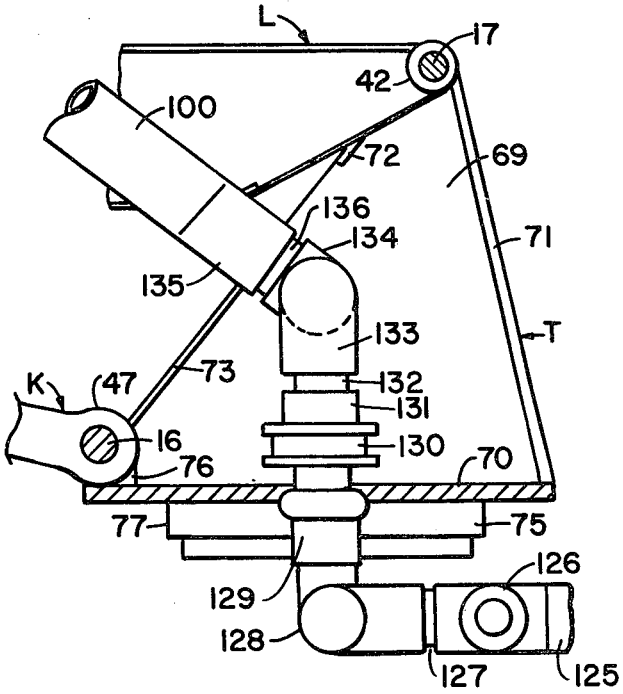
FIG. 20 is a limited vertical section, on an enlarged scale, taken at the position of line 20—20 of FIG. 19 and showing particularly a piping assembly for supplying the hose and pipe structure of FIG. 17 with water, with a number of parts of FIGS. 18 and 19 being omitted for clarity of illustration.

A water connection at approximately the center of turntable T, for supplying water to hose 100 for nozzle N, is illustrated in FIG. 20. Such a connection may include an inlet hose 125 extending to a check valve 126, in turn connected by a pipe connection 127 with a tee 128, which permits the rear connection shown, or an alternative connection at either side, to accommodate different piping arrangements on pumpers, for instance. Tee 128 is connected to a special swivel joint 129, preferably a Chicksan, which permits the turntable to rotate through 360° without interference with the supply of fluid to nozzle N. Above an upper flange of swivel joint 129 is a ring 130, which permits ready substitution of a shut off valve, if one is desired at the turntable. A flanged connector 131 above ring 130 is connected to a nipple 132, which leads to an ell 133. Ell 133, in combination with an ell 134, permits pivotal movement of the lower end of hose 100 relative to the turntable, while hose 100 is provided with a swaged connector 135, connected by nipple 136 to the outlet of ell 134.

Swivel joint 129 may be centered with respect to the turntable C, so that the connection between it and the upper outlet of tee 128 can rotate 360°. Tees 133 and 134 produce an offset in the supply line, so that hose 100 will extend alongside the lower boom, instead of directly beneath it. In addition to the parts referred to above, other parts which are shown in FIG. 20, shown also in figures previously described, are identified by the same reference numerals.

A further advantage of the lift of this invention, when nozzle N for producing a high velocity stream of water for fire fighting purposes is controlled by a fireman in basket B, is that the weight of the fireman in the basket tends to counterbalance the thrust reaction of the nozzle. Considering the area between lines 6 and 7 of FIG. 3, it will be noted that the weight of a person in the basket B always produces a force tending to move the basket in a clockwise direction, the amount of the force depending on the extension of extensible boom E. When extending to its fullest, as would be usual in placing the nozzle to direct water onto the burning building as effectively as possible, the clockwise force produced by the weight of the person in the basket would be generally at a maximum. However, when a nozzle N is mounted on the extensible boom, as in FIGS. 17 and 18, the reaction of the nozzle produces a force tending to move the basket in a counterclockwise direction, i.e. opposite the direction of the weight of the person in the basket. Thus, the lift of this invention becomes more stable when the nozzle N is operating. This effect may be compared with the effect of the nozzle reaction on a boom which is upright along the center line 5 of FIG. 3, to achieve a maximum height. While the weight of the person in the basket produces a force straight down and thus does not tend to overturn the lift and vehicle, the reaction force of the nozzle is as great in this position as any other position of the lift, but there is nothing to counteract it. Such a reaction can be as high as 300 pounds for a nozzle operating at p.s.i. water pressure, significant enough to require outriggers to be placed on a vehicle, even though the boom is in an upright position.

Although more than one embodiment of this invention and certain variations thereof have been illustrated and described, it will be understood that other embodiments may exist and that other variations may be utilized, without departing from the spirit and scope of this invention.

What is claimed is:

1. An aerial lift for a vehicle, comprising:

a support pivotally mounted on said vehicle for movement about an upright axis;

a lower boom whose inner end is pivotally connected to said support and extending generally horizontally in a storage position;

means for moving said lower boom upwardly and downwardly about the pivotal connection thereof and disposed at an acute angle to said lower boom in said storage position, said moving means being pivotally connected to said support and to said lower boom;

an upper boom whose inner end is pivotally associated with the outer end of said lower boom and which extends in a generally horizontal storage position above said lower boom;

link means whose inner end is pivotally connected to said support and whose outer end is pivotally associated with the inner end of said upper boom; and the relationship of the lengths between pivots of said lower boom and said link means, the distance between the pivotal connections of said lower boom and said link means to said support and the distances between the points of pivotal association between said lower boom and said link means with said upper boom being such that the outer end of said upper boom will be raised generally vertically as said lower boom is raised.

2. An aerial lift as defined in claim 1, wherein:

said link means comprises a pair of links disposed on opposite sides of said moving means and thereby stabilizes said upper boom laterally.

3. An aerial lift as defined in claim 2, including:

an extensible boom movable outwardly and inwardly from the upper end of said upper boom;

means for moving said extensible boom relative to said upper boom; and the outer end of said extensible boom rising generally vertically as said lower boom is raised for retracted, extended and intermediate positions of said extensible boom when the position of said extensible boom remains unchanged during lifting of said lower boom.

4. An aerial lift as defined in claim 3, including:

a workman's basket connected to the outer end of said extensible boom.

5. An aerial lift as defined in claim 3, including:

a fluid discharge nozzle mounted on the outer end of said extensible boom; and means for supplying fluid to said nozzle.

6. An aerial lift as defined in claim 5, wherein:

said support comprises a turntable rotatable about a vertical axis through 360°; and said means for supplying fluid to said nozzle includes a swivel joint at approximately the center of said turntable.

7. An aerial lift as defined in claim 6, wherein:

said extensible boom is slidably mounted within said upper boom;

said means for supplying fluid to said nozzle includes a first pipe attached longitudinally to said upper boom; and a second pipe slidable within said first pipe and connected to the outer end of said extensible boom for movement therewith.

8. An aerial lift as defined in claim 7, wherein said fluid supply means includes:

a third pipe mounted on said lower boom;

a hose connecting the outer end of said third pipe with the inner end of said second pipe;

a supply pipe including a swivel joint mounted centrally of said turntable; and a hose connecting said supply pipe with the inner end of said third pipe.

9. An aerial lift as defined in claim 2, wherein:

said pair of links and said moving means are pivotally connected to said support at laterally adjacent positions.

10. An aerial lift as defined in claim 1, wherein:

said link means comprises a pair of laterally spaced links extending between said support and said pivotal association with said upper boom.

11. An aerial lift as defined in claim 10, wherein:

a hydraulic cylinder and piston rod are adapted to move said lower boom upwardly and downwardly;

one of said hydraulic cylinder and piston rod is pivoted between said pair of links on a pivot pin for said links; and the other of said hydraulic cylinder and piston rod is pivotally connected to the underside of said lower boom.

12. An aerial lift for a vehicle, comprising:

a pivotal support mountable on said vehicle;

a lower boom whose inner end is pivotally connected to said support;

means for moving said lower boom upwardly and downwardly about the pivotal connection thereof and pivotally connected between said support and said lower boom;

link means pivotally connected at the inner end thereof to said support and disposed on opposite sides of said moving means;

an upper boom whose inner end is pivotally associated with the outer end of said lower boom and said link means;

an extensible boom movable outwardly and inwardly from the upper end of said upper boom;

means for moving said extensible boom relative to said upper boom;

a device for accomplishing an objective connected to the outer end of said extensible boom; and joint means attached to the inner end of said upper boom, pivotally connected to the outer end of said lower boom at a position below said upper boom and pivotally connected to the outer end of said link means at a position below said pivotal connection to said lower boom, said joint means being formed of relatively heavy material to assist in counterbalancing the weight of said extensible boom and said device for accomplishing an objective.

13. An aerial lift as defined in claim 12, wherein:

said joint means includes a pair of generally triangular side plates attached to the sides of said upper boom, depending angularly from the inner end of said upper boom and extending downwardly and rearwardly therefrom.

14. An aerial lift as defined in claim 13, wherein:

a pivot pin for the upper end of said lower boom extends between said side plates at a position intermediate said side plates; and a pivot pin for the outer end of said link means extends between said side plates adjacent the lower corner thereof.

15. An aerial lift as defined in claim 13, wherein:

said joint means includes an upper plate and a lower plate extending along and respectively attached to the top and bottom of said upper boom and extending between said side plates rearwardly from the inner edge.

16. An aerial lift as defined in claim 12, wherein:

said support includes a turntable rotatable about 360°;

said device comprises a basket connected to the outer end of said extensible boom; and the weight of said joint means tends to counterbalance the weight of said extensible boom, said basket and a load carried by said basket, in any position of said turntable.

17. An aerial lift for a vehicle, comprising:

a support mountable on said vehicle, including a fixed portion and a turntable pivotable about an upright axis;

a lower boom whose inner end is pivotally connected to said turntable and extending generally horizontally in a storage position;

means for moving said lower boom upwardly and downwardly about the pivotal connection thereof;

an upper boom whose inner end is pivotally associated with the outer end of said lower boom and extending generally horizontally above said lower boom in a storage position;

link means whose inner end is pivotally connected to said turntable and whose outer end is pivotally associated with the inner end of said upper boom;

a fixed arm extending outwardly from the fixed portion of said support; and said link means and arm having cooperating locking means, whereby said lower boom may be lowered and said turntable rotated so that said locking means will be engaged to resist lateral movement of said link means, lower boom and upper boom during movement of said vehicle.

18. An aerial lift as defined in claim 17, wherein:

said link means includes a pair of laterally spaced links;

a cross bar extends laterally between said links; and said cooperating locking means is mounted on said cross bar and the outer end of said fixed arm.

* * * * *